US007690219B2

(12) United States Patent
Suzuki et al.

(10) Patent No.: US 7,690,219 B2
(45) Date of Patent: Apr. 6, 2010

(54) VAPOR COMPRESSION REFRIGERATING SYSTEMS AND MODULES WHICH COMPRISE A HEAT EXCHANGER DISPOSED WITHIN A GAS-LIQUID SEPARATOR

(75) Inventors: Kenichi Suzuki, Takasaki (JP); Masato Tsuboi, Isesaki (JP); Yuuichi Matsumoto, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 145 days.

(21) Appl. No.: 11/624,023

(22) Filed: Jan. 17, 2007

(65) Prior Publication Data

US 2007/0163296 A1 Jul. 19, 2007

(30) Foreign Application Priority Data

Jan. 17, 2006 (JP) ..... 2006-008577

(51) Int. Cl.
*F25B 43/00* (2006.01)

(52) U.S. Cl. ..... 62/512; 62/503; 62/475

(58) Field of Classification Search ..... 62/470, 62/475, 503, 512, 513
See application file for complete search history.

(56) References Cited

U.S. PATENT DOCUMENTS

| | | | | |
|---|---|---|---|---|
| 5,385,203 | A * | 1/1995 | Mitsuhashi et al. | 165/110 |
| 6,349,566 | B1 * | 2/2002 | Howard et al. | 62/627 |
| 6,530,230 | B2 | 3/2003 | Makizono et al. | |
| 6,681,597 | B1 | 1/2004 | Yin et al. | |
| 6,959,556 | B2 * | 11/2005 | Inoue et al. | 62/6 |

FOREIGN PATENT DOCUMENTS

| | | |
|---|---|---|
| JP | H10-019421 A | 1/1998 |
| JP | 2001-116405 A | 4/2001 |

* cited by examiner

*Primary Examiner*—Melvin Jones
(74) *Attorney, Agent, or Firm*—Baker Botts, LLP.

(57) ABSTRACT

A module, such as a module configured to be used in a refrigeration system, includes a gas-liquid separator which is configured to receive a first refrigerant, to separate the first refrigerant into a gas portion of the first refrigerant and a liquid portion of the first refrigerant, and to transmit the gas portion of the first refrigerant. The module also includes a heat exchanger which is configured to receive a second refrigerant and to exchange heat between the second refrigerant and the gas portion of the first refrigerant and/or the liquid portion of the first refrigerant. Moreover, the heat exchanger is disposed within the gas-liquid separator.

13 Claims, 6 Drawing Sheets

VAPOR COMPRESSION REFRIGERATING SYSTEMS AND MODULES WHICH COMPRISE A HEAT EXCHANGER DISPOSED WITHIN A GAS-LIQUID SEPARATOR

BACKGROUND OF THE INVENTION

1. Field of the Invention

The present invention relates generally to vapor compression refrigerating systems and modules which are used in such vapor compression refrigerating system. In particular, the present invention is directed towards vapor compression refrigerating systems and modules in which the module comprises a gas-liquid separator and a heat exchanger disposed within, e.g., surrounded by, the gas-liquid separator.

2. Description of Related Art

An exemplary, known vapor compression refrigerating system, such as the vapor compression refrigerating system described in Japanese Patent Publication No. JP-A-11-193967, uses a natural refrigerant, such as carbon dioxide, as a refrigerant. The known vapor compression refrigerating system includes an inside heat exchanger for exchanging heat between refrigerant at an exit side of a radiator and refrigerant at a suction side of a compressor, which increases an efficiency of the vapor compression refrigerating system.

One exemplary, known vapor compression refrigerating system is depicted in FIG. 11. The high-temperature and high-pressure refrigerant compressed by a compressor 201 is introduced into a radiator 202, and heat is exchanged between the refrigerant and an outside fluid. The refrigerant flows from radiator 202 to an inside heat exchanger 203, and then from inside heat exchanger 203 to a pressure-reducing mechanism 204 which reduces the pressure of the refrigerant. The pressure reduced refrigerant flows from pressure-reducing mechanism 204 to an evaporator 205, and then from evaporator 205 to a gas-liquid separator 206. The gas-liquid separator 206 then separates a gas portion of the refrigerant from a liquid portion of the refrigerant, stores the liquid portion of the refrigerant, and the gas portion of the refrigerant flows from gas-liquid separator 206 to inside heat exchanger 203. Heat then is exchanged between the refrigerant which flows from radiator 202 to inside heat exchanger 203 and the gas portion of the refrigerant which flows from gas-liquid separator 206 to inside heat exchanger 203. The gas portion of the refrigerant then flows from inside heat exchanger 203 to compressor 201.

In a vapor compression refrigerating system including such an inside heat exchanger, a pressure in the high-pressure side of the system may be elevated by decreasing a specific enthalpy of refrigerant at the exit side of the radiator, as compared with a refrigerating system which does not include an inside heat exchanger. Consequently, it may be possible to improve a coefficient of performance of the system, and to prevent a liquid compression of the compressor by providing a certain degree of superheating to the refrigerant which is sucked into the compressor.

When carbon dioxide is used as the refrigerant, although the refrigerant discharged from the compressor is cooled by the radiator, because the refrigerant at the outlet of the radiator may reach a supercritical condition without being liquefied when a temperature of an outside fluid, e.g., air, to be exchanged in heat with the refrigerant in the radiator exceeds a certain temperature, e.g., a temperature greater than the critical temperature of carbon dioxide, if the pressure of the refrigerant is reduced and the refrigerant is evaporated by an evaporator, the refrigeration ability of the refrigeration system may substantially decrease. Therefore, exchanging heat between the refrigerant at the exit side of the radiator and the refrigerant at the suction side of the compressor via the inside heat exchanger may increase or maintain the refrigeration ability of the refrigerating system, and also may reduce the pressure of the high-pressure side and improve the coefficient of performance of the refrigerating system.

Another known vapor compression refrigerating system is described in Japanese Patent Publication No. JP-A-2004-100974. In this known vapor compression refrigerating system, the number of refrigerant tubes and coupling portions thereof are reduced by integrally forming the inside heat exchanger around a refrigerant storing space of the gas-liquid separator, thereby reducing the number of parts used in the refrigerating system and the amount of space occupied by the refrigerating system.

Nevertheless, when the inside heat exchanger is provided as a single, separated piece of equipment, because refrigerant tubes and coupling portions therefor are required for the inside heat exchanger, it may be difficult to reduce the cost of the system. Further, when the inside heat exchanger is integrated with the gas-liquid separator around the gas-liquid separator, although the number of the refrigerant tubes and the coupling portions therefor is reduced, the configuration of the integrated equipment may become complicated, and it may be difficult to practically manufacture the integrated equipment. Moreover, oil in the gas-liquid separator may remain inside the inside heat exchanger integrated with the gas-liquid separator.

SUMMARY OF THE INVENTION

Therefore, a need has arisen for a vapor compression refrigerating systems which overcome these and other shortcomings of the related art. A technical advantage of the present invention is that a vapor compression refrigerating system may include a module which includes a gas-liquid separator and a heat exchanger disposed within, e.g., surround by, the gas-liquid separator. This may reduce the number of parts included in the refrigerating system, the costs associated with maintaining the refrigerating system, and the weight of the weight of the refrigerating system, relative to known refrigerating systems.

According to an embodiment of the present invention, a vapor compression refrigerating system comprises a compressor configured to compress a refrigerant, and a radiator in fluid communication with the compressor. The radiator is configured to receive the refrigerant from the compressor and to reduce a temperature of the refrigerant. The system also comprises a module in fluid communication with each of the radiator and the compressor, and the module is configured to receive the refrigerant from the radiator. The system further comprises a first pressure-reducing mechanism in fluid communication with the module, and the first pressure-reducing mechanism is configured to receive the refrigerant from the first pressure-reducing module and to reduce a pressure of the refrigerant. Moreover, the system comprises an evaporator in fluid communication with each of the first pressure-reducing mechanism and the module, and the evaporator is configured to receive the refrigerant from the first pressure-reducing mechanism and to evaporate the refrigerant, and the module is further configured to receive the refrigerant from the evaporator. Specifically, the module comprises a gas-liquid separator which is configured to receive the refrigerant from the evaporator, to separate the refrigerant into a gas portion of the refrigerant and a liquid portion of the refrigerant, and to transmit the gas portion of the refrigerant to the compressor. The module also comprises a heat exchanger which is configured to receive the refrigerant from the radiator and to exchange heat between the refrigerant received from the radiator and at least one of the gas portion of the refrigerant and the liquid portion of the refrigerant. For example, heat may be exchanged between the refrigerant received from the radiator and both the gas portion of the refrigerant and the liquid portion of the refrigerant. Moreover, the heat exchanger is disposed within, e.g., surrounded by, the gas-liquid separator.

According to another embodiment of the present invention, a module comprises a gas-liquid separator which is configured to receive a first refrigerant, to separate the first refrigerant into a gas portion of the first refrigerant and a liquid portion of the first refrigerant, and to transmit the gas portion of the first refrigerant. The module also comprises a heat exchanger which is configured to receive a second refrigerant and to exchange heat between the second refrigerant and at least one of the gas portion of the first refrigerant and the liquid portion of the first refrigerant. Moreover, the heat exchanger is disposed within, e.g., surrounded by, the gas-liquid separator.

Other objects, features, and advantage will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS

Embodiments of the present invention, and their features and advantages, may be understood by referring to FIGS. 1-10, like numerals being used for like corresponding parts in the various drawings.

Figure 1:
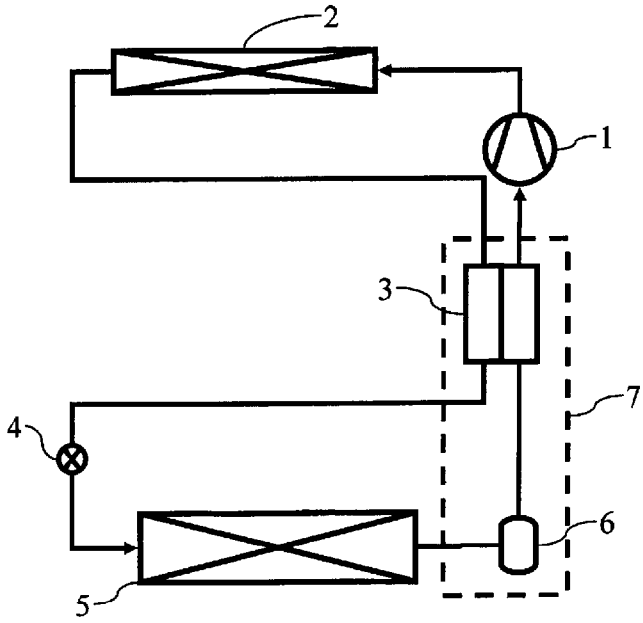
FIG. 1 is a circuit diagram of a refrigerating system, according to an embodiment of the present invention.

FIG. 1 depicts a circuit diagram of a vapor compression refrigerating system, according to an embodiment of the present invention. The vapor compression refrigerating system may comprise a compressor 1, a radiator 2 in fluid communication with compressor 1, a heat exchanger 3 in fluid communication with each of radiator 2 and compressor 1, and a pressure-reducing mechanism 4 in fluid communication with heat exchanger 3. The vapor compression refrigerating system also may comprise an evaporator 5 in fluid communication with pressure-reducing mechanism 4, and a gas-liquid separator 6 in fluid communication with each of evaporator 5 and heat exchanger 3.

In operation, a refrigerant, such as a natural refrigerant, e.g., carbon dioxide, may be compressed by compressor 1, which contracts the refrigerant and increases the temperature of the refrigerant. The refrigerant then may flow from compressor 1 to radiator 2, and heat may be exchanged between the refrigerant and an outside fluid, e.g., air. The refrigerant then may flow from radiator 2 to heat exchanger 3, and the refrigerant may be cooled by an exchange of heat with refrigerant flowing in a circuit of a suction side of compressor 1. The refrigerant then may flow from heat exchanger 3 to pressure-reducing mechanism 4 which may reduce the pressure of the refrigerant. The refrigerant then may flow from pressure reducing mechanism 4 to evaporator 5, and heat may be exchanged between the refrigerant and the outside fluid. The refrigerant then may flow from evaporator 5 to gas-liquid separator 6. Gas-liquid separator 6 may separate a gas portion of the refrigerant from a liquid portion of the refrigerant, store the liquid portion of the refrigerant, and supply the gas portion of the refrigerant to a refrigerant circuit in fluid communication with compressor 1.

Figure 2:
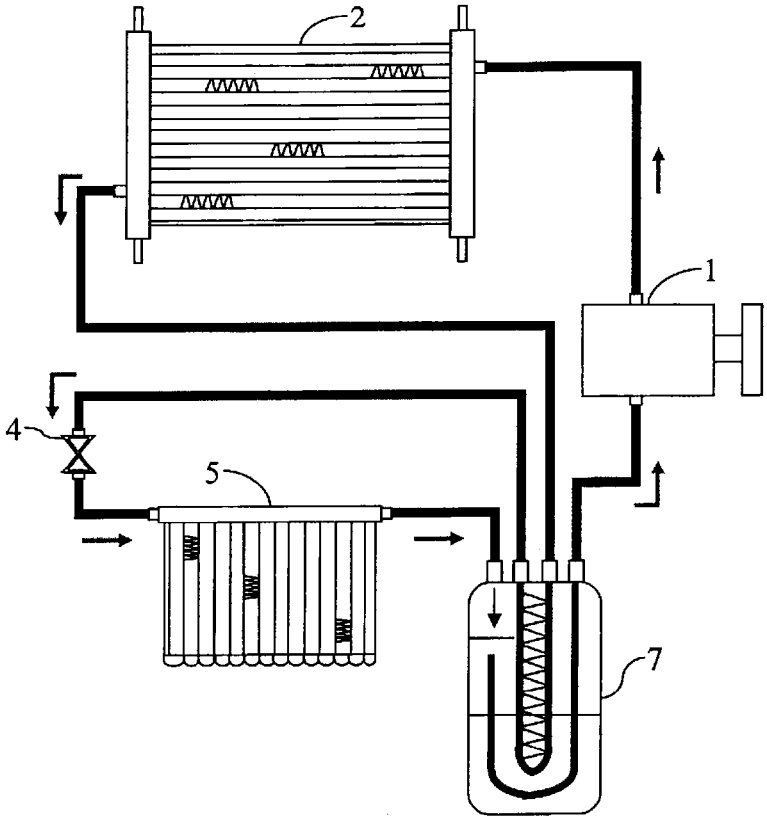
FIG. 2 is a schematic, circuit diagram of the refrigerating system of FIG. 1.

For example, referring to FIG. 2, heat exchanger 3 may be formed integral with gas-liquid separator 6, such that heat exchanger 3 and gas-liquid separator 6 comprise a module 7. The liquid portion of the refrigerant may be stored in the bottom portion in module 7, and the gas portion of the refrigerant may be discharged from module 7 and transmitted to compressor 1. In module 7, the refrigerant which flows from radiator 2 passes through a refrigerant storing space in module 7, the refrigerant is cooled by a low-pressure refrigerant of the liquid portion of the refrigerant and the gas portion of the refrigerant present in module 7, and the refrigerant flows out from module 7 to pressure-reducing mechanism 4.

Figure 3:
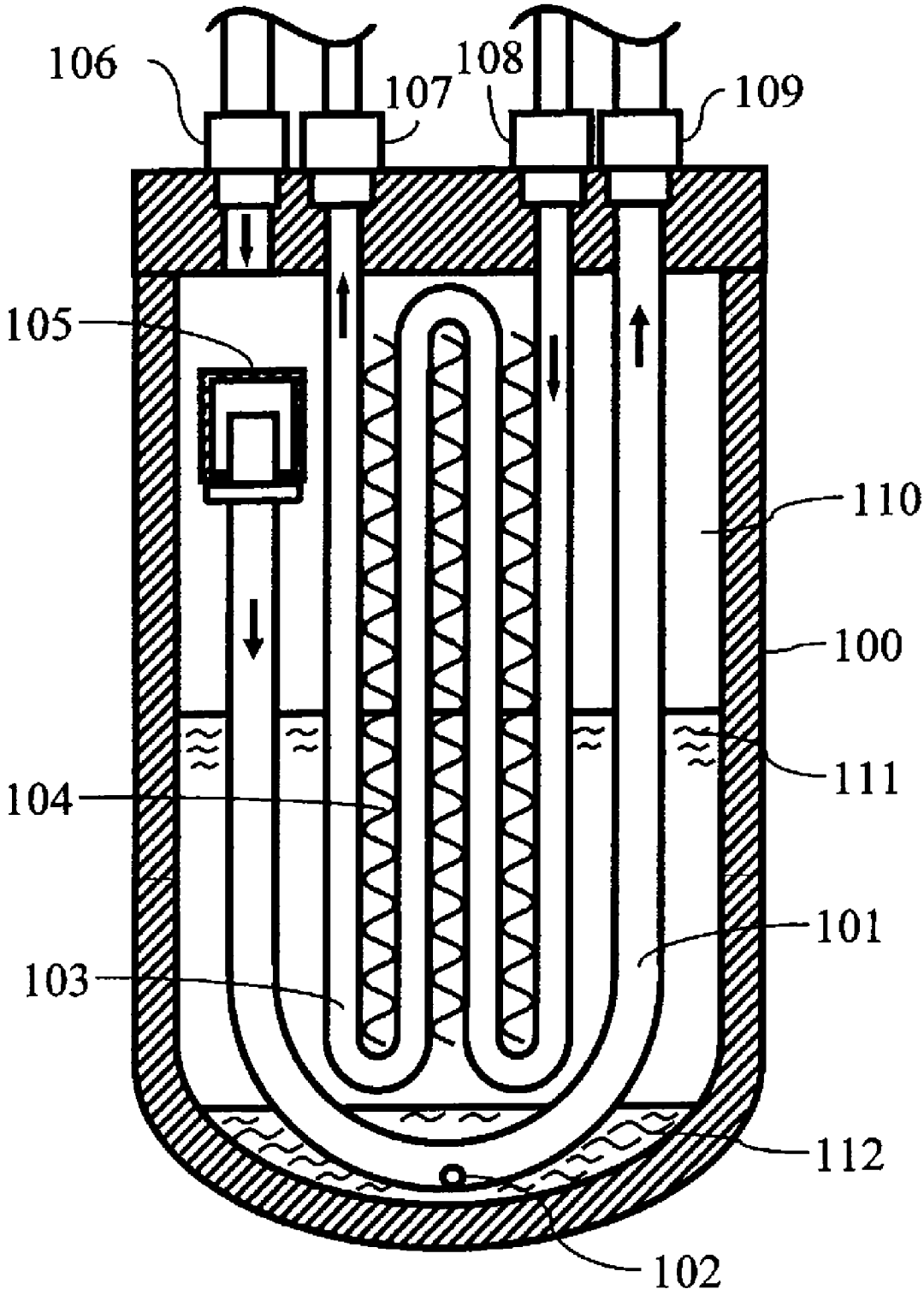
FIG. 3 is a vertical, sectional view of a module of the refrigerating system of FIG. 1, according to an embodiment of the present invention.

FIG. 3 depicts module 7, according to an embodiment of the present invention. Module 7 may comprise a refrigerant storing vessel 100 which separates the refrigerant into a gas portion of the refrigerant and a liquid portion of the refrigerant, and stores an excessive liquid refrigerant portion of the refrigerant. Refrigerant flows from evaporator 5 flows to a low-pressure refrigerant inlet 106, the and refrigerant is separated into a gas portion of the refrigerant and a liquid portion of the refrigerant 111, and the liquid portion of the refrigerant 111 is stored therein. The refrigerant which flows from evaporator 5 may include a lubricant, such as oil, and oil 112 may be separated from the refrigerant which flows from evaporator 5 and may be stored in the bottom portion in module 7. The gas portion of the refrigerant is discharged from a low-pressure refrigerant discharge tube 101 to compressor 1. Moreover, at least a portion of oil 112 stored in the bottom portion in module 7 is sucked through an oil returning hole 102 provided at a lower portion of low-pressure refrigerant discharge tube 101, and the sucked portion of the oil is sent to compressor 1 with the gas portion of the refrigerant through a low-pressure refrigerant outlet 109. A diffuser 105 prevents the gas-liquid mixed refrigerant which flows from low-pressure refrigerant inlet 106 into module 7 from directly flowing into low-pressure refrigerant discharge tube 101. The oil and the liquid portion of the refrigerant may not be completely separated as depicted in the FIG. 3, and in practice, a small amount of liquid refrigerant generally is contained in the oil.

Figure 4:
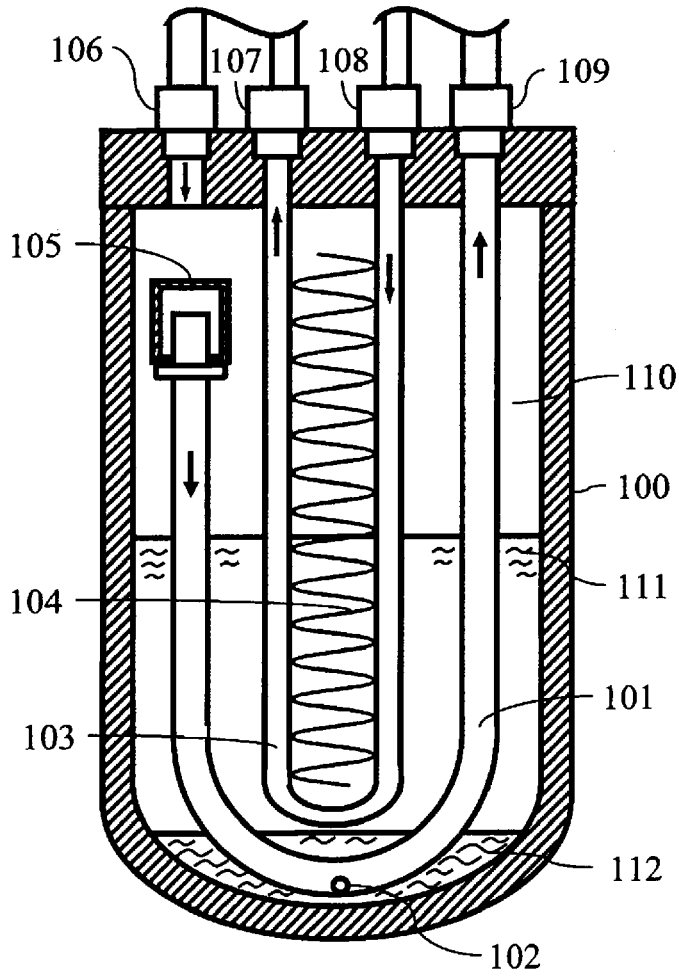
FIG. 4 is a vertical, sectional view of a module of a refrigerating system, according to another embodiment of the present invention.

Referring to FIGS. 3 and 4, the high-temperature and high-pressure refrigerant which flows from radiator 2 flows into module 7 through a high-pressure refrigerant inlet 108, passes through a high-pressure refrigerant tube 103, e.g., a substantially W-shaped tube or a substantially U-shaped tube, and flows out to pressure-reducing mechanism 4 through a high-pressure refrigerant outlet 107. A portion of high-pressure refrigerant tube 103 may contact the liquid portion of the refrigerant 111, as depicted in FIG. 3, and the high-temperature and high-pressure refrigerant may be cooled by an exchange of heat between the high-temperature and high-pressure refrigerant flowing in the tube 103 and the liquid portion of the refrigerant 111. Moreover, because heat also may be exchanged between high-pressure refrigerant tube 103 and the gas portion of the refrigerant in refrigerant storing space 110, the high-temperature and high-pressure refrigerant flowing in tube 103 may be cooled by both the gas portion of the refrigerant and the liquid portion of the refrigerant 111 present in refrigerant storing space 110. Moreover, fins 104 may provided on the surface of high-pressure refrigerant tube 103, which may further accelerate the exchange of heat between the high-temperature and high-pressure refrigerant and the refrigerant present in refrigerant storing space 110. High-pressure refrigerant tube 103 may be structured by forming a flat tube with a plurality of holes therein disposed in parallel to each other as a W-shaped configuration or a U-shaped configuration, and providing fins between the tube portions of the tube.

Figure 5:
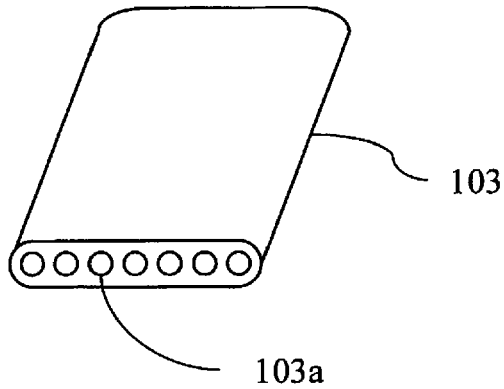
FIG. 5 is a perspective view of an exemplary flat tube with a plurality of holes therein disposed in parallel to each other, according to an embodiment of the present invention.
Figure 6:
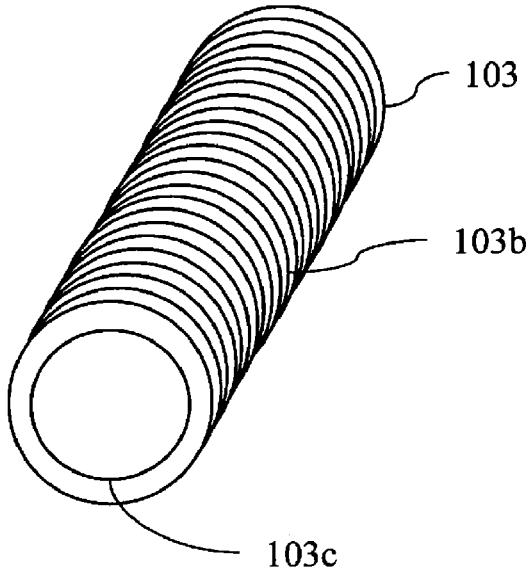
FIG. 6 is a perspective view of an exemplary low-fin tube, according to an embodiment of the present invention.

FIG. 5 depicts an example of a flat tube with a plurality of holes therein disposed in parallel to each other for forming high-pressure refrigerant tube 103. The plurality of parallel holes form a plurality of parallel refrigerant passages 103*a*. Further, as depicted in FIG. 6, a low-fin tube formed with a refrigerant passage 103*c* and provided with low fins 103*b* on the surface may be used as high-pressure refrigerant tube 103. Such a low-fin tube may be manufacture by rolling.

In this embodiment of the present invention, inlet 106, inlet 108, outlet 107, and outlet 109 each may be provided on the same surface, e.g., the upper surface, of module 7, such that module 7 may be compact, and even when module 7 is mounted to a vehicle, the tubes readily may be coupled.

Figure 7:
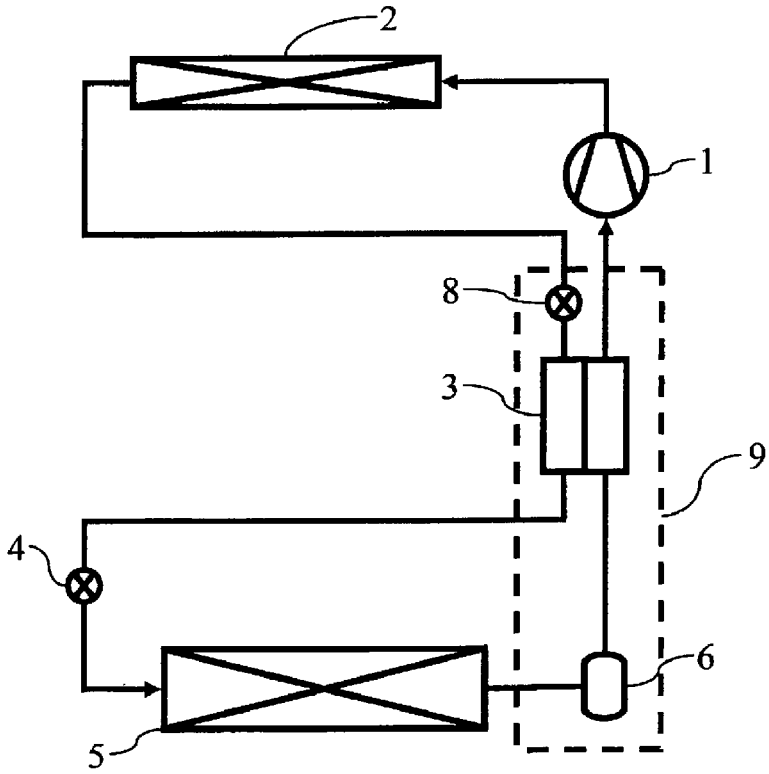
FIG. 7 is a circuit diagram of refrigerating system, according to another embodiment of the present invention.

FIG. 7 depicts a vapor compression refrigerating system, according to another embodiment of the present invention. The vapor compression refrigerating system of this embodiment of the present invention is substantially similar to the vapor compression refrigerating system of the above-described embodiments of the present invention. Therefore, only those differences between this embodiment of the present invention and the above-described embodiments of the present invention are discussed with respect to this embodiment of the present invention. In this embodiment of the present invention, a pressure-reducing mechanism 8 is added to the vapor compression refrigerating system. Specifically, pressure-reducing mechanism 8 is in fluid communication with radiator 2 and heat exchanger 3, such that heat exchanger 3 is in fluid communication with radiator 2 via pressure-reducing mechanism 8. Specifically, the refrigerant flows from radiator 2 to pressure-reducing mechanism 8 which reduces the pressure of the refrigerant, and the pressure-reduced refrigerant then flows to heat exchanger 3 which cools the refrigerant by the refrigerant of the suction side of compressor 1. The cooled refrigerant then flows to first pressure-reducing mechanism 4 which reduces the pressure of the cooled refrigerant. The remaining operation of the vapor compression refrigerating system in this embodiment of the present invention is substantially the same as in the above-described embodiments of the present invention.

Figure 8:
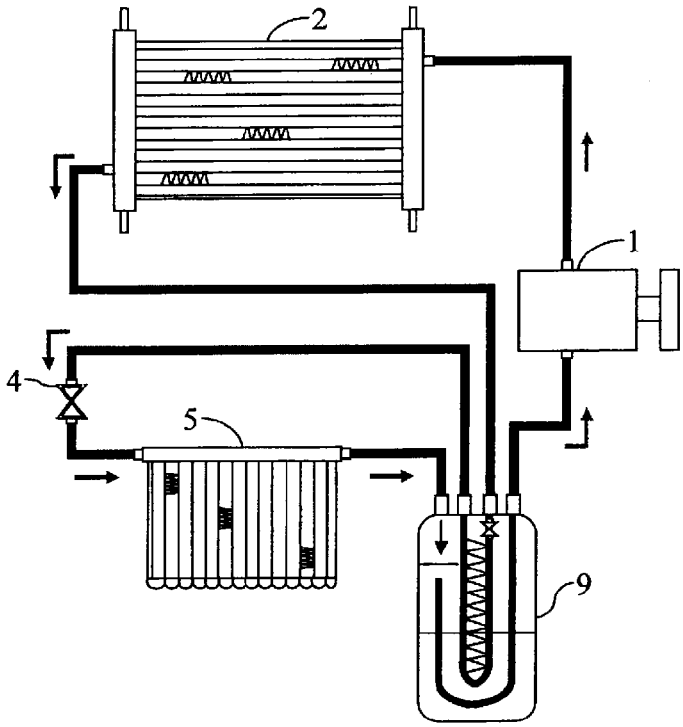
FIG. 8 is a schematic, circuit diagram of the refrigerating system of FIG. 7.

Referring to FIG. 8, in an embodiment of the present invention, second pressure-reducing mechanism 8, heat exchanger 3, and gas-liquid separator 6 are integrally formed as a module 9. With respect to this embodiment of the present invention as compared to the above-described embodiments of the present invention, because second pressure-reducing mechanism 8 in module 9 reduces the pressure of the refrigerant passing through the refrigerant storing space of module 9, it is possible to decrease the thickness of the material of the tube passing through the space to be less than the thickness of the high-pressure refrigerant tube used in the first embodiment.

Figure 9:
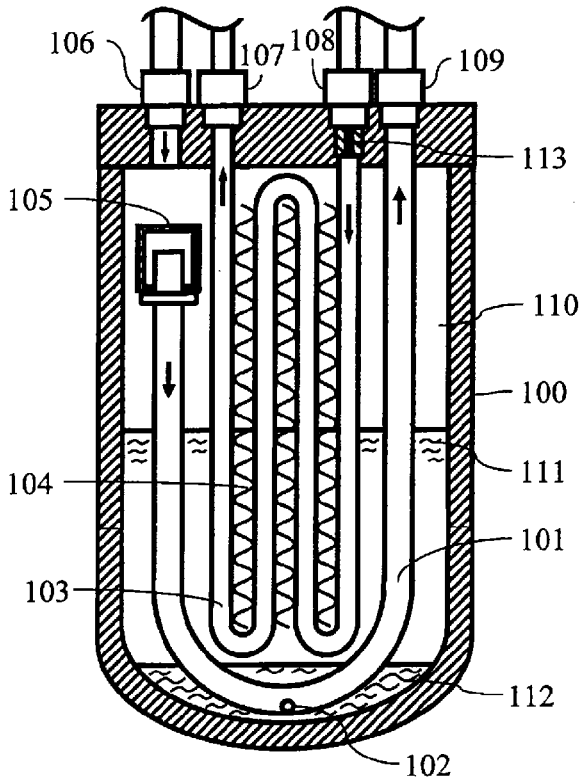
FIG. 9 is a vertical, sectional view of a module of the refrigerating system of FIG. 7, according to an embodiment of the present invention.

Referring to FIG. 9, with respect to module 9, the high-temperature and high-pressure refrigerant which flows from radiator 2 flows into an orifice 113 and reduced in pressure by orifice 113. For example, orifice 113 may correspond to second pressure-reducing mechanism 8. The remaining components of module 9 operate in substantially the same manner as their corresponding components in module 7. Therefore, module 9 is not discussed in further detail.

Figure 10:
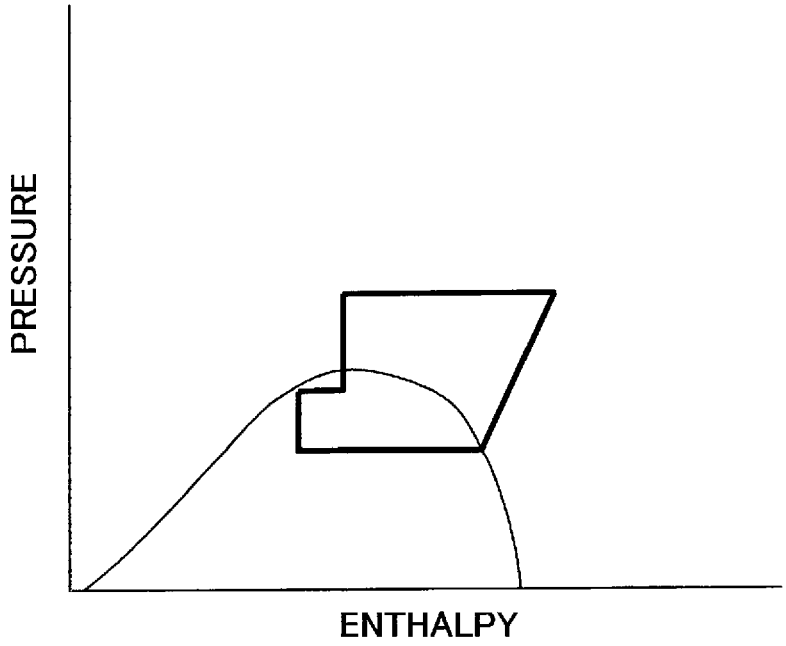
FIG. 10 is a Mollier chart of the refrigerating system of FIG. 7, according to an embodiment of the present invention.
Figure 11:
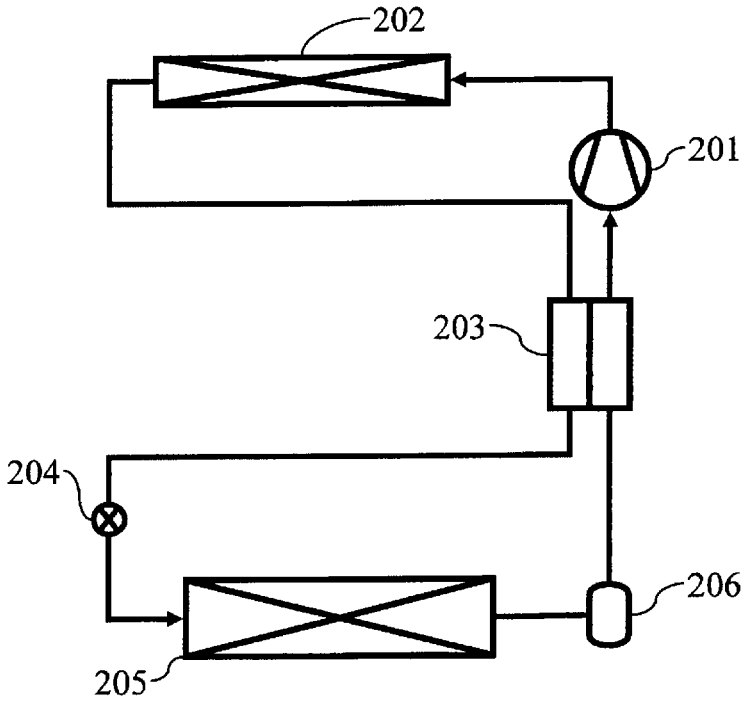
FIG. 11 PRIOR ART
FIG. 11 is a circuit diagram of a known refrigerating system.

In this embodiment, because the pressure inside high-pressure refrigerant tube 103 may be less than in the above-described embodiments, the thickness of high-pressure refrigerant tube 103 in this embodiment may be less than the thickness of high-pressure refrigerant tube 103 in the above-described embodiments, such that the exchange of heat between the refrigerant which flows from radiator 2 and the liquid portion of the refrigerant 111 and the gas portion of the refrigerant may occur more quickly in this embodiment relative the above-described embodiments. FIG. 10 shows a Mollier chart in the operation of the refrigerating system according to this second embodiment.

The module according to the present invention is suitable for a vapor compression refrigerating system, in particular, for a vapor compression refrigerating system using carbon dioxide as its refrigerant, especially, a vapor compression refrigerating system used in an air conditioning system for a vehicle.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. A vapor compression refrigerating system comprising:

a compressor configured to compress a refrigerant;

a radiator in fluid communication with the compressor, wherein the radiator is configured to receive the refrigerant from the compressor and to reduce a temperature of the refrigerant;

a module in fluid communication with each of the radiator and the compressor, wherein the module is configured to receive the refrigerant from the radiator;

a first pressure-reducing mechanism in fluid communication with the module, wherein the first pressure-reducing mechanism is configured to receive the refrigerant from the module and to reduce a pressure of the refrigerant; and an evaporator in fluid communication with each of the first pressure-reducing mechanism and the module, wherein the evaporator is configured to receive the refrigerant from the first pressure-reducing mechanism and to evaporate the refrigerant, and the module is further configured to receive the refrigerant from the evaporator, wherein the module comprises:

a gas-liquid separator which is configured to receive the refrigerant from the evaporator, to separate the refrigerant into a gas portion of the refrigerant and a liquid portion of the refrigerant, and to transmit the gas portion of the refrigerant to the compressor; and a heat exchanger which is configured to receive the refrigerant from the radiator and to exchange heat between the refrigerant received from the radiator and at least one of the gas portion of the refrigerant and the liquid portion of the refrigerant, wherein the heat exchanger is disposed within the gas-liquid separator, wherein a portion of a refrigerant passage extending between the radiator and the first pressure-reducing mechanism passes through an inside of the module.

2. The vapor compression refrigerating system of claim 1, wherein the gas-liquid separator has a refrigerant storing space formed therein, and the portion of the refrigerant passage which passes through the inside of the module passes through the refrigerant storing space.

3. The vapor compression refrigerating system of claim 2, wherein the liquid portion of the refrigerant is stored in the refrigerant storing space, and the portion of the refrigerant passage which passes through the refrigerant storing space contacts the liquid portion of the refrigerant stored in the refrigerant storing space.

4. The vapor compression refrigerating system of claim 1, wherein the portion of the refrigerant passage which passes through the inside of the module comprises a substantially W-shaped tube.

5. The vapor compression refrigerating system of claim 1, wherein the portion of the refrigerant passage which passes through the inside of the module comprises a substantially U-shaped tube.

6. The vapor compression refrigerating system of claim 1, wherein the portion of the refrigerant passage which passes through the inside of the module comprises a substantially flat tube having a plurality of holes formed therein, wherein the plurality of holes are disposed in parallel to each other.

7. The vapor compression refrigerating system of claim claim 1, wherein the portion of the refrigerant passage which passes through the inside of the module comprises a tube, and the heat exchanger comprises fins provided on the tube.

8. The vapor compression refrigerating system of claim 7, wherein the tube comprises a low-fin tube.

9. The vapor compression refrigerating system of claim 1, wherein the module further comprises a plurality of refrigerant inlets and a plurality of refrigerant outlets formed therethrough, and each of the plurality of refrigerant inlets and the plurality of refrigerant outlets are formed through a same surface of the module.

10. The vapor compression refrigerating system of claim 1, further comprising a second pressure-reducing mechanism in fluid communication with each of the radiator and the module, wherein the second pressure-reducing mechanism is configured to receive the refrigerant from radiator, to reduce a pressure of the refrigerant, and to transmit the refrigerant to the module, wherein the second pressure-reducing mechanism is integral with the module.

11. The vapor compression refrigerating system of claim 1, wherein the refrigerant comprises carbon dioxide.

12. The vapor compression refrigerating system of claim 1, wherein the heat exchanger which is configured to exchange heat between the refrigerant received from the radiator and each of the gas portion of the refrigerant and the liquid portion of the refrigerant.

13. An air conditioning system for a vehicle, comprising the vapor compression refrigerating system of claim 1.

* * * * *